United States Patent [19]

Beisswenger et al.

[11] Patent Number: 4,776,288

[45] Date of Patent: Oct. 11, 1988

[54] METHOD FOR IMPROVING SOLIDS DISTRIBUTION IN A CIRCULATING FLUIDIZED BED SYSTEM

[75] Inventors: Hans Beisswenger, Mahwah, N.J.; Alexander T. Wechsler, Riverdale, N.Y.

[73] Assignee: Metallgesellschaft Aktiengesellschaft, Frankfurt am Main, Fed. Rep. of Germany

[21] Appl. No.: 80,424

[22] Filed: Jul. 31, 1987

[51] Int. Cl.[4] ..... F23B 7/00

[52] U.S. Cl. ..... 110/341; 110/245; 110/347; 122/4 D; 165/104.16

[58] Field of Search ..... 122/4 D; 431/7, 170; 165/104.16; 110/245, 347, 341

[56] References Cited

U.S. PATENT DOCUMENTS

| | | | |
|---|---|---|---|
| 4,111,158 | 9/1978 | Reh et al. . | |
| 4,165,717 | 8/1979 | Reh et al. . | |
| 4,244,779 | 1/1981 | Nieminen et al. . | |
| 4,311,670 | 1/1982 | Nieminen et al. . | |
| 4,442,797 | 4/1984 | Strohmeyer, Jr. | 122/4 D |
| 4,469,050 | 9/1984 | Korenberg | 122/4 D |
| 4,594,967 | 6/1986 | Wolowodiuk | 122/4 D |
| 4,656,972 | 4/1987 | Shimoda | 122/4 D |
| 4,684,375 | 8/1987 | Morin et al. | 110/347 |
| 4,716,856 | 1/1988 | Beisswenger et al. . | |

*Primary Examiner*—Edward G. Favors

*Attorney, Agent, or Firm*—Felfe & Lynch

[57] ABSTRACT

Disclosed is a process for improving the solids distribution in a circulating fluidized bed system. In the invention, hot ash from the system and fresh carbonaceous fuel are mixed in a chamber which is fluidized so as to form a fluidization zone wherein the heavier material is concentrated and a second fluidization zone which consists predominantly of fines at least a portion of which is separated from the heavier material. This zone separation is facilitated in part by maintaining different gas-mass flow rates so as to form a plug of heavier material. At least a portion of the fine material is then transferred into the reactor while the coarse material is further processed.

18 Claims, 2 Drawing Sheets

METHOD FOR IMPROVING SOLIDS DISTRIBUTION IN A CIRCULATING FLUIDIZED BED SYSTEM

The present invention is in a method of improving the solids distribution in a circulating fluidized bed (CFB) reactor system and in particular in combustion systems.

In recent years, combustion systems utilizing circulating fluidized bed boilers have enjoyed expanded applications. Typical systems are disclosed in U.S. Pat. No. 4,165,717 and U.S. Pat. No. 4,111,158.

In CFB combustion systems heat transfer means, such as panels, tubes or water walls have been placed above the secondary air inlet in the combustion chamber. In other arrangements at least a portion of the heat of combustion is removed in an external fluidized bed heat exchanger. The solids loading or solids density in the upper section of the reactor is highly influencial from a heat transfer point of view, and in achieving an effective and efficient overall operation of such a system. Thus it is of importance to achieve and maintain a satisfactory distribution of solids in the reactors in an industrial CFB plant. In U.S. Pat. No. 4,165,717, the disclosure of which is incorporated herein by reference, Reh et al disclose that heat transfer can be controlled by controlling the solids density in the combustion chamber.

Various techniques have been used to improve the solids concentration profile in the combustor. These include a combination of measures such as: increased primary air flow, increased gas velocity in the reducing zone (tapered combustor), multi-level secondary air injection, more stringent fuel crushing specifications, and where possible, use of air swept mills.

However, the above measures have not eliminated the formation of a relatively dense, high pressure loss lower bed section composed of ash and fuel when fuel specifications have not been one. Gravel size particles are fluidized in the "bubbling bed" mode at the lower velocities used in the lower combustor. Since these coarse particles are too large to be recycled and too fine to segregate to the bottom of the combustor, where the bed drains are located, the gravel particles essentially build up and float in an expanded "bubbling bed" mode in the lower bed of the combustor forming in effect a "gravel plug". The amount of coarse solids "floating" in the lower bed is difficult to control by increased ash discharge through the grate, since this may lead to solids imbalance in the system.

The "gravel plug" in the lower bed affects the CFB operation and performance in numerous ways. When the pressure drop through the lower bed is high, the solids density in the upper combustor is low. This translates into lower heat transfer coefficients and low heat transfer in the upper combustor. The low solids density also means that there is not sufficient back mixing and the gas/solids reactions are not optimized. In those systems using an external fluidized bed heat exchanger, the formation of a gravel plug in the lower combustor eventually results in insufficient solids for the external heat exchanger and thus low heat transfer.

Another drawback is that a large part of the heat generated in the reducing zone is used to heat up the large mass of solids contained in the lower combustor. At high solids flow through the external fluidized bed heat exchanger, this large mass acts as a "heat sink" reducing the lower combustor temperature and the carbon burn-out.

The concentration of a large amount of the solids in the lower zone includes a significant fraction of sulfur grabbers. Thus, sulfur removal efficiency is low because the lime sulfation process to form gypsum favors an oxygen-rich atmosphere.

SUMMARY OF THE INVENTION

The present invention overcomes the aforementioned disadvantages and others.

In the invention, the solids distribution in the CFB system is improved. Hot ash from the system and fresh carbonaceous fuel are mixed in a chamber which is fluidized so as to form a fluidization zone wherein the heavier material is concentrated and a second fluidization zone which consists predominantly of fines at least a portion of which is separated from the heavier material. This zone separation is facilitated in part by maintaining different gas-mass flow rates so as to form a plug of heavier material.

The fluidizing gas can be air or an oxygen deficient gas phase such as an inert gas or a flue gas. Preferably, the gas is cleaned to remove very fine particulate in an electrostatic precipitator or bag house before contacting the fuel-ash mixture in the chamber.

At least a portion of the heavy material is discharged from the respective fluidizing zone, is cooled, crushed as necessary, and then also may be injected into the combustor. At least a portion of the fine material from the second fluidization zone is introduced into the lower section of the combustor. Another portion of the fine material can be drawn off and passed to an external fluidized bed heat exchanger. The cooled solids withdrawn from the external fluidized bed heat exchanger can be subsequently introduced into the lower section of the combustor.

The mixture of the ash and carbonaceous fuel feed can take place in a separate mixing chamber. However, it is also possible to utilize a loop seal or L valve for this purpose. Another alternative is to mix the material in an integrally formed external fluidized bed heat exchanger, the construction of which is disclosed in U.S. Pat. No. 4,716,850, the disclosure of which is incorporated herein by reference.

The chamber itself may be of constant cross section dimensions or may have a convergence so as to increase the velocity of the fluidizing gas therein to form the separate fluidization zones. The mixing chamber can be operated by introducing the fluidizing gas at one or more different levels. If the gas is introduced into the chamber on more than one level, the relative volumes and velocities of the gas streams can be controlled and/or varied to form and control the various fluidization zones.

The mixture of the fuel with the hot ash from the CFB system and the flue gas enables the inexpensive pre-drying of the fuel in the mixing chamber.

In another embodiment of the invention, the fine particles separated from the heavier material in the mixing chamber can be passed to an external fluidized bed heat exchanger before the particulate is injected into the combustor. One such arrangement for the external fluidized bed heat exchanger is as shown in U.S. Pat. No. 4,111,158 to Plass et al, the disclosure of which is incorporated herein by reference.

Coarse particles collected in the lower bed of the chamber can be discharged. The discharged material is cooled and crushed to approximately 1.0 mm×0 and can be reinjected into the combustor. The char may contain uncontrolled amounts of CaS. Therefore, the char/ash cooling and conveying crushing loop should be maintained dry, and under negative pressure.

The system described above presents a number of advantages. It ensures a positive control of the particle size of the solids fed into the CFB, and hence better control of particle size distribution. This results in an improved pressure profile, and therefore improved performance, i.e., higher heat transfer rate, better sulfur removal efficiency and higher carbon burnout.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENTS

Figure 1:
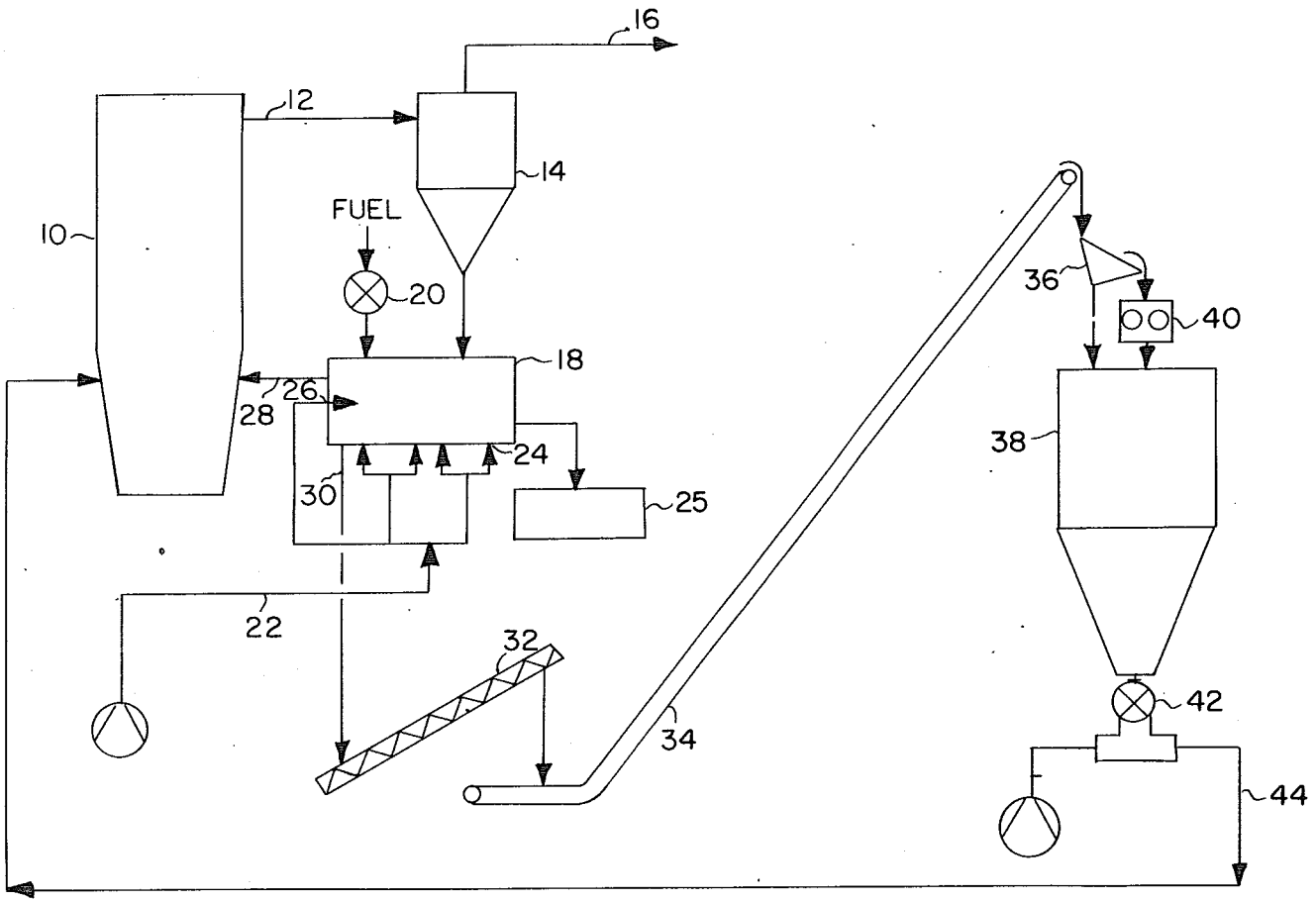
FIG. 1 schematically depicts the method of the invention.

As shown in FIG. 1, a CFB combustor 10 is exhausted near its top. The exhaust gas stream 12 contains suspended solids and is ducted into a cyclone 14 wherein a substantial portion of the entrained solids are separated from the gas stream. The so treated exhaust gas 16 may then pass through an economizer etc., (not shown). After the recovery of any additional heat contained therein, the gas stream will eventually be passed through a gas cleaning apparatus (not shown) such as an electrostatic precipitator or bag house so that any particulate remaining in the gas can be captured. The hot ash collected in cyclone 14 feeds directly, or through a duct, into a chamber 18 wherein fresh carbonaceous fuel from feeder 20 is mixed therewith.

The hot ash can be discharged directly from the elongated or lower cone of the cyclone. In such an arrangement a seal must be formed by a head of material. However, one may use an air- lock device at the cone discharge to effect the seal and dispense with maintaining the head of material to seal against misdirected flow. Alternatively, a connecting duct can extend from the cyclone discharge with a sealing device as part thereof.

Figure 2:
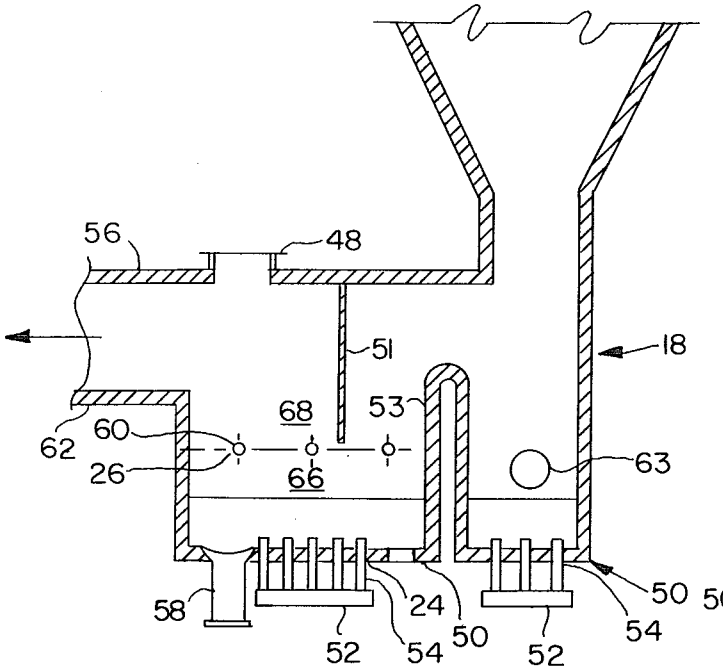
FIG. 2 illustrates a mixing chamber useful in the invention.

In the preferred embodiment, cleaned flue gas 22 is introduced into chamber 18 as the fluidizing gas. However, air or an inert or oxygen deficient gases may also be used. In one embodiment, the flue gas is injected into chamber 18 on at least one level through injection ports 24 (FIG. 2). The flue gas 22 can also be injected at a second level by ports 26. The multi-level injection technique will produce two different fluidization zones in the chamber. However, as discussed below it is possible to generate more than one fluidization zone using a single injection plane.

At least a portion of the fines 28 from chamber 18 are introduced into the combustor below the secondary air inlet. Another portion of the fines can be passed to an external fluidized bed heat exchanger 25 wherein thermal energy can be recovered. The cooled solids can then be passed into the combustor 10. In that embodiment where the external fluidized bed heat exchanger is integral to the combustor, chamber 18 and the external fluidized bed heat exchanger are effectively combined.

At least a portion of the heavy material is discharged from chamber 18 through a line 30 and is cooled. In a preferred embodiment, the ash is cooled in a cooler 32 which is preferably a screw cooler. The cooled heavy material is discharged from cooler 32 and can be conveyed via a conveying system 34. The cooled heavy material is sized preferably to a 1 mm cut by screen 36. The −1 mm material feeds into a bin 38 and the oversized material is processed in a roll crusher 40 to form material preferably −1 mm and then fed into bin 38. The material in bin 38 is gravity fed through a feeder device 42 into a pneumatic conveying system 44 by which it is injected into the CFB below the secondary air inlet. It will be understood that if there is a multilevel injection of secondary air into the combustor, the injection from system 44 is at or below the uppermost of the secondary air inlet levels of the combustor.

FIG. 2 shows a preferred mixing chamber 18. Mixing chamber 18 is adapted with a fuel feed port 48 for introduction of the carbonaceous material. The chamber 18 has a fluidization grid 50. A header pipe 52 carries pressurized gas which is injected through grid 50 into chamber 18 by tubes 54 near the lower section of the chamber. A solids duct 56 through which the fines are conveyed extends from the chamber 18 to the combustor 10. The chamber 18 is provided with a solids drain 58 through which discharge solids are removed. The chamber 18 can also be provided with injection ports 60 through which a secondary gas can be introduced into the chamber. The level of secondary gas introduction is above the fluidizing grid 50 and will have a significant impact on the lower boundary of the second fluidization zone wherein fine particulate is primarily entrained. The injection ports 60 are no higher than, and preferably below, the lowermost wall 62 of the solids duct 56. The chamber also has a solids flow control valve 63 whereby a portion of the fine material can be removed for transfer to the external fluidized bed heat exchanger 25.

Chamber 18 is fashioned with internal baffles or plates 51 and 53 which are so located so as to allow a build up of material to form a seal thus preventing material blowback or misdirected flow into the elongated cone of cyclone 14.

Figure 3:
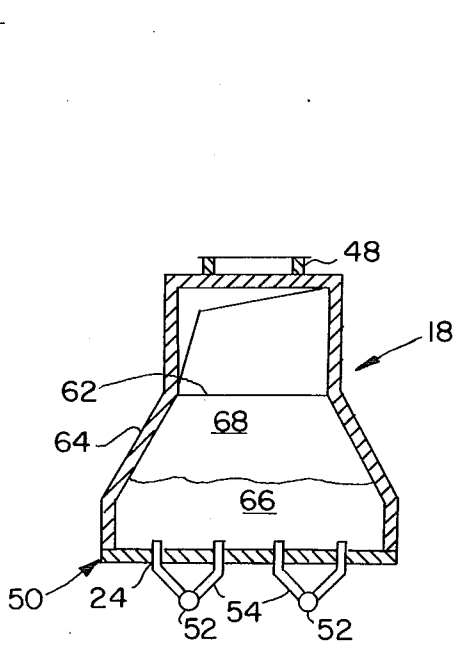
FIG. 3 illustrates an end view of another mixing chamber useful in the invention.

FIG. 3 shows an end view of another embodiment of chamber 18 with a lower fluidization grid 50, header 52 and tubes 54. The lower wall 62 of the solids duct from the chamber to the combustor is also indicated as is the fuel feed port 48.

In the FIG. 3 embodiment, chamber 18 is fashioned with a convergent or restricted section 64. In this embodiment, there is no second level of gas introduction into the chamber and lower wall 62 of the solids duct is at a restricted cross section of the chamber. Because of the reduced cross section resulting from restricted section 64, the gas velocity will increase in the restricted area effectively forming a first and second fluidization zone.

In operation, the mixing chamber 18 will contain a first and second fluidization zone respectively shown in FIG. 3 as 66 and 68. The velocity of the fluidizing gas in the lower section of the chamber (zone 66) will be from about 0.1 to 1 meters per second. The velocity of the fluidizing gas in the less dense fluidization zone 68 will be of the order of 0.5 to 5 meters per second. Zone 66 will consist primarily of the heavier material in the range of greater than 1000μ (nominally) while zone 68 will consist primarily of the finer material of less than 1000μ (nominally).

The fine material which contains some fuel will overflow and/or can be conveyed by the fluidizing gas of chamber 18 into the solids duct 56 and into the combustor 10 at a section that is below the secondary air inlet of the combustor. The heavier material will be removed from the chamber 18 through drain 58 to line 30 and is processed as described above.

EXAMPLE

In an 80 MW(e) plant, hot ash is discharged from the elongated cone of a cyclone of a CFB combustion system into a mixing chamber at a rate of 800 to 1000 tons per hour. The hot ash is at a temperature of 1560° F. Carbonaceous fuel in the form of coal is fed into the chamber at a rate of 20 tons per hour. The fuel has an ash content of 15.6% and a moisture content of 5.6%.

A primary stream of clean recycled flue gas from the combustor 10 is injected as fluidizing gas at a rate of 950 SCFM at a temperature of 300° F. through the bottom grid 50 of chamber 18. The fluidizing velocity of the flue gas is 0.2 m/sec. A secondary stream of fluidizing gas is injected at a second level which is approximately 1.5 meters below the lower wall 62 of the solids duct 56 from the chamber to the combustor. The secondary gas is introduced into chamber 18 at a rate of 7,125 SCFM and provides a fluidizing velocity of 1.5 m/sec in the area of the chamber just below the solids duct. Approximately 500 tons per hour of fines under 0.5 to 1 millimeter are transferred into the combustor 10 from chamber 18 through the duct 56. 15 tons per hour of coarse material is discharged to a screw cooler. The coarse material is cooled indirectly and countercurrently in the screw type cooler by 260 gallons per minute of water which enters the screw cooler at 60° F. and leaves at about 130° F. The essentially dry and cooled ash, which is at a temperature of 300° to 500° F., is transported in a pneumatic conveying system. The transporting gas preferably has a low relative humidity.

The cooled ash is transported to a sizing screen which allows nominally −1 mm size particulate to pass into a bin. The oversized material is fed into a roll type crusher wherein large or agglomerated particulate are reduced in size and fed into the bin. The sized material from the bin is pneumatically conveyed back into the combustor at a rate of 15 tons per hour.

The combustor which is operated at a pressure drop of from about 55 to 65 inches wg from above the primary grid, experiences a 25% improvement in the heat transfer coefficient in the combustor above the secondary air inlet.

It will be understood that the specification and examples are illustrative but not limitative of the present invention and that other embodiments within the spirit and scope of the invention will suggest themselves to those skilled in the art.

We claim:

1. A process for improving solids distribution in a reactor of a circulating fluidized bed system, comprising:

removing hot ash from the reactor of the circulating fluidized bed system;

mixing fuel with the removed hot ash in a mixing chamber;

introducing into the chamber as fluidizing gas air or an oxygen deficient gas phase and operating said chamber to have at least two fluidizing zones therein, a first of said zones containing predominantly heavier material and a second of said zones containing primarily fine particles separated from the heavier material;

removing at least a portion of the separated fine particles from the mixing chamber; and introducing said removed fine particles into said reactor.

2. The process of claim 1 wherein the system is a combustion system and the reactor is a combustor.

3. The process of claim 2 wherein the fluidizing gas is a flue gas.

4. The process of claim 3 wherein the flue gas is cleaned.

5. The process of claim 2 further comprising removing at least a portion of the heavier material from the chamber, cooling said removed heavier material, crushing the cooled material and injecting said material into the combustor.

6. The process of claim 1 wherein the mixing chamber is in the form of a seal pot.

7. The process of claim 2 wherein at least a portion of ash is removed from the circulating system of the circulating fluidized bed combustion system.

8. The process of claim 2 wherein the ash is removed from the combustor.

9. The process of claim 2 wherein the ash of the heavier material is screened.

10. The process of claim 2 wherein the mixing chamber is an external fluidized bed heat exchanger which is integral to said combustor.

11. The process of claim 5 wherein the cooled and crushed material is introduced into a holding means from which it is conveyed to the combustor.

12. The process of claim 2 wherein the fluidizing gas is introduced into said mixing chamber on one or more levels.

13. The process of claim 12 wherein the relative volumes and velocities of the fluidizing gas introduced at the one or more different levels is varied to control the size range of the solids fed from the chamber into the combustor.

14. The process of claim 2 wherein the fuel is dried in said chamber prior to the fuel's introduction into the combustor.

15. The process of claim 2 wherein at least a portion of the fine material is passed to an external fluidized bed heat exchanger prior to its introduction into the combustor.

16. The process of claim 5 wherein the cooling and crushing are performed under conditions wherein there is no free moisture.

17. The process of claim 16 wherein the cooling and conveying are conducted under suction conditions.

18. The process of claim 2 wherein fluidizing gas is introduced on only one level and the cross sectional area of the chamber is restricted to cause an increase of velocity in an upper section of the chamber to form the second fluidization zone.

* * * * *

UNITED STATES PATENT AND TRADEMARK OFFICE

CERTIFICATE OF CORRECTION

PATENT NO. : 4,776,288

DATED : October 11, 1988

INVENTOR(S) : Hans Beisswenger et al.

It is certified that error appears in the above-identified patent and that said Letters Patent is hereby corrected as shown below:

Column 1, line 38: change "one" to read -- met --.

Column 2, line 42: change "4,716,850" to read -- 4,716,856 --.

Signed and Sealed this

Tenth Day of April, 1990

*Attest:*

HARRY F. MANBECK, JR.

*Attesting Officer*

*Commissioner of Patents and Trademarks*